US008863322B2

(12) United States Patent
Kuang

(10) Patent No.: US 8,863,322 B2
(45) Date of Patent: Oct. 21, 2014

(54) JET APPARATUS FOR TOILET

(75) Inventor: Qifeng Kuang, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 512 days.

(21) Appl. No.: 13/277,055

(22) Filed: Oct. 19, 2011

(65) Prior Publication Data

US 2012/0174309 A1 Jul. 12, 2012

(30) Foreign Application Priority Data

Oct. 21, 2010 (CN) ..... 2010 1 0514971
Oct. 21, 2010 (CN) ..... 2010 2 0573289 U

(51) Int. Cl.
*A47K 3/20* (2006.01)
*E03D 9/08* (2006.01)

(52) U.S. Cl.
CPC ..... *E03D 9/08* (2013.01)
USPC ..... 4/420.4

(58) Field of Classification Search
CPC ..... E03D 9/08
USPC ..... 4/300–448
See application file for complete search history.

(56) References Cited

U.S. PATENT DOCUMENTS 5,431,187 A 7/1995 Nee

FOREIGN PATENT DOCUMENTS

| | | | |
|---|---|---|---|
| CN | 201169821 | Y | 12/2008 |
| CN | 101974931 | A | 2/2011 |
| CN | 201826381 | U | 5/2011 |
| JP | 10018388 | A | 1/1998 |
| JP | 3163982 | B2 | 5/2001 |
| KR | 100804304 | B1 | 2/2008 |
| WO | WO 01/36758 | A1 | 5/2001 |

OTHER PUBLICATIONS

International Search Report and Written Opinion for Application No. PCT/IB2011/002919, mail date Mar. 29, 2012, 8 pages.

*Primary Examiner* — Lori Baker
(74) *Attorney, Agent, or Firm* — Foley & Lardner LLP

(57) ABSTRACT

A jet apparatus for a toilet includes a base, a fixed support provided with a longitudinal opening, and a mobile support including a longitudinal support body and an installation portion disposed on the support body. The support body is received inside the opening and is capable of moving inside the opening. A jet pipe is rotatably installed on the installation portion of the mobile support and includes a jet pipe body, a nozzle formed at the front end of the jet pipe body, a rotation portion disposed at the rear end of the jet pipe body, and an inlet pipe connected with a cleaning water pipe. A drive motor for driving the mobile support to move is also included, and the jet apparatus further includes a fan-shaped engaging gear disposed on the rotation portion. A matching gear for engaging with the fan-shaped engaging gear is disposed on the fixed support.

30 Claims, 5 Drawing Sheets

JET APPARATUS FOR TOILET

CROSS-REFERENCE TO RELATED PATENT APPLICATIONS

The present application claims priority to and the benefit of the following applications, the entire disclosures of which are incorporated herein by reference: China P.R. Priority Application No. 201010514971.X, filed Oct. 21, 2010, and China P.R. Priority Application No. 201020573289.3, filed Oct. 21, 2010.

BACKGROUND

The present application relates to a jet apparatus and a toilet installed with the jet apparatus, in particular to a jet apparatus and a toilet installed with the jet apparatus for cleaning portions of a human body (e.g., genital and anal areas).

Toilets installed with jet apparatuses (also referred to as bidets) are commonly installed in bathrooms such that people can sit while cleaning genital and anal areas with clean water sprayed from a cleaning jet pipe, and thereby achieving the effect of cleaning human genital and anal areas. When a user defecates and presses a rear cleaning button, a rear jet pipe protrudes forward and sprays cleaning water to the user's anal area. When the user presses a front cleaning button, a front jet pipe protrudes forward and sprays cleaning water to the user's genital area. When the cleaning is completed, the cleaning jet pipes return to the initial position.

Known jet apparatuses typically have a cylindrical telescopic structure. When a user needs to use the jet apparatus, the cleaning jet pipe inside a jet apparatus extends out of the jet apparatus and sprays cleaning water. When not in use, the cleaning jet pipe retracts back inside the jet apparatus. The direction of the line on which the jet pipe extends is defined as the longitudinal direction, and the direction perpendicular thereto is defined as the horizontal direction. However, known cleaning jet pipes are typically only capable of longitudinal extension and refraction. That is, they are unable to move horizontally. As a result, known jet apparatus are unable to adjust positions as required by different users. Moreover, known jet apparatuses typically have relatively large longitudinal sizes, making them unfit for some toilets that do not have sufficient dimensions to accommodate such jet apparatuses.

Furthermore, known jet apparatuses are typically installed at a rear end of the toilet body. When the jet pipe extends out, it sprays cleaning water forward in a slanted manner. However, such a configuration may undesirably cause used cleaning water to impact the genital area in front of the anal area after cleaning the anal area.

It would be advantageous to provide an improved jet apparatus and a toilet incorporating the jet apparatus.

SUMMARY

An exemplary embodiment relates to a jet apparatus for a toilet that includes a base, a fixed support provided with a longitudinal opening, and a mobile support that includes a longitudinal support body and an installation portion disposed on the support body, wherein the support body is received inside the opening of the fixed support and is capable of moving inside the opening. A jet pipe is rotatably installed on the installation portion of the mobile support and includes a jet pipe body, a nozzle formed at the front end of the jet pipe body, a rotation portion disposed at the rear end of the jet pipe body, and an inlet pipe connected with a cleaning water pipe.

The jet apparatus also includes a drive motor for driving the mobile support to move, and the jet apparatus further includes a fan-shaped engaging gear disposed on the rotation portion, and a matching gear for engaging with the fan-shaped engaging gear is disposed on the fixed support.

Another exemplary embodiment relates to a toilet comprising a jet apparatus that includes a base, a fixed support comprising a longitudinal opening, and a mobile support comprising a longitudinal support body and an installation portion disposed on the support body, wherein the support body is received inside the opening of the fixed support and is capable of moving inside the opening. The jet apparatus also includes a jet pipe rotatably installed on the installation portion of the mobile support and comprising a jet pipe body, a nozzle formed at the front end of the jet pipe body, a rotation portion disposed at the rear end of the jet pipe body, and an inlet pipe connected with a cleaning water pipe. The jet apparatus further includes a drive motor for driving the mobile support to move. The jet apparatus further includes a fan-shaped engaging gear disposed on the rotation portion, and a matching gear for engaging with the fan-shaped engaging gear disposed on the fixed support.

Another exemplary embodiment relates to a toilet that includes a jet apparatus installed inside a seat ring of the toilet. The jet apparatus includes a base comprising an axle portion and a mobile support installed on the base and capable of movement relative to the base. The mobile support comprises a longitudinal support body and an installation portion disposed on the support body. A jet pipe is installed on the installation portion of the mobile support and includes a rotation portion. The jet apparatus also includes a drive motor for driving the mobile support to move. The seat ring includes an opening configured to allow the jet pipe to extend out of the opening or move. The seat ring comprises an engagement portion for engaging with the axle portion of the base. The jet apparatus further comprises a base driving mechanism that drives the base to rotate around the line of the axle portion.

DETAILED DESCRIPTION

One challenge facing designers of bidets is that of providing the user with the ability to position and change the characteristics of the water spray so that it impacts the desired location on the user's body in a way that satisfies the user's preferences. The present application describes a configuration that helps to address this challenge. For example, the jet apparatus disclosed herein may be advantageously configured to allow a user to more flexibly aim the water spray at a desired location. One aspect of this configuration is that two jet pipes or wands may be included and configured so that they are positionable and rotatable in a manner that allows the spray to be directed more accurately. For example, the jet pipes may be configured in a way that the sprays from the jet pipes intersect when they spray water (e.g., due to the fact that the pipes are linked and move in tandem with each other) according to an exemplary embodiment. According to an exemplary embodiment, the geometry of the spray shape and the force with which the spray contacts the user may be adjusted to provide desired spray characteristics. In this manner, the spray may be "tuned" to the user's preferences. These and other advantages will be apparent to those reviewing the present disclosure.

A jet apparatus for installation with a toilet and a toilet using such a jet apparatus will be described below according to various exemplary embodiments. The jet apparatuses may utilize, for example, jet apparatuses that have jet pipes (also referred to as bidet wands) that extend from the side of the toilet inward and that may be adjustable to provide greater flexibility for the user in positioning the water spray. One advantageous feature of such jet apparatuses and toilets using such jet apparatuses is that the user may have a more comfortable cleaning experience by virtue of the fact that the jet pipe position may be adjusted by the user to a desired position. The jet apparatus may also be installed inside a toilet seat ring by virtue of its structural features, which may allow the cleaning water to first impact the front of the user (e.g., the genital area) before traveling rearward (e.g., toward the anal area).

Figure 1:
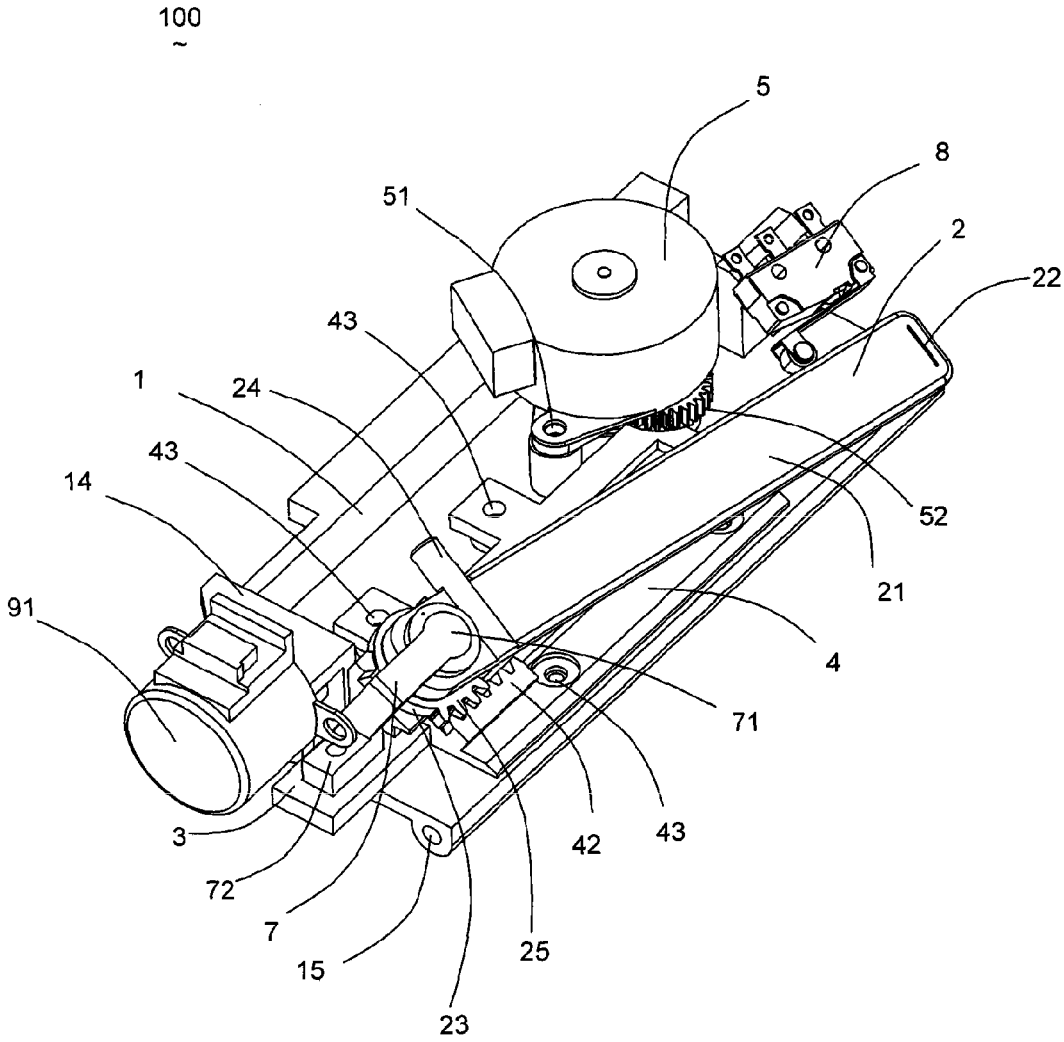
FIG. 1 is a perspective view of a jet apparatus according to an exemplary embodiment.
Figure 2:
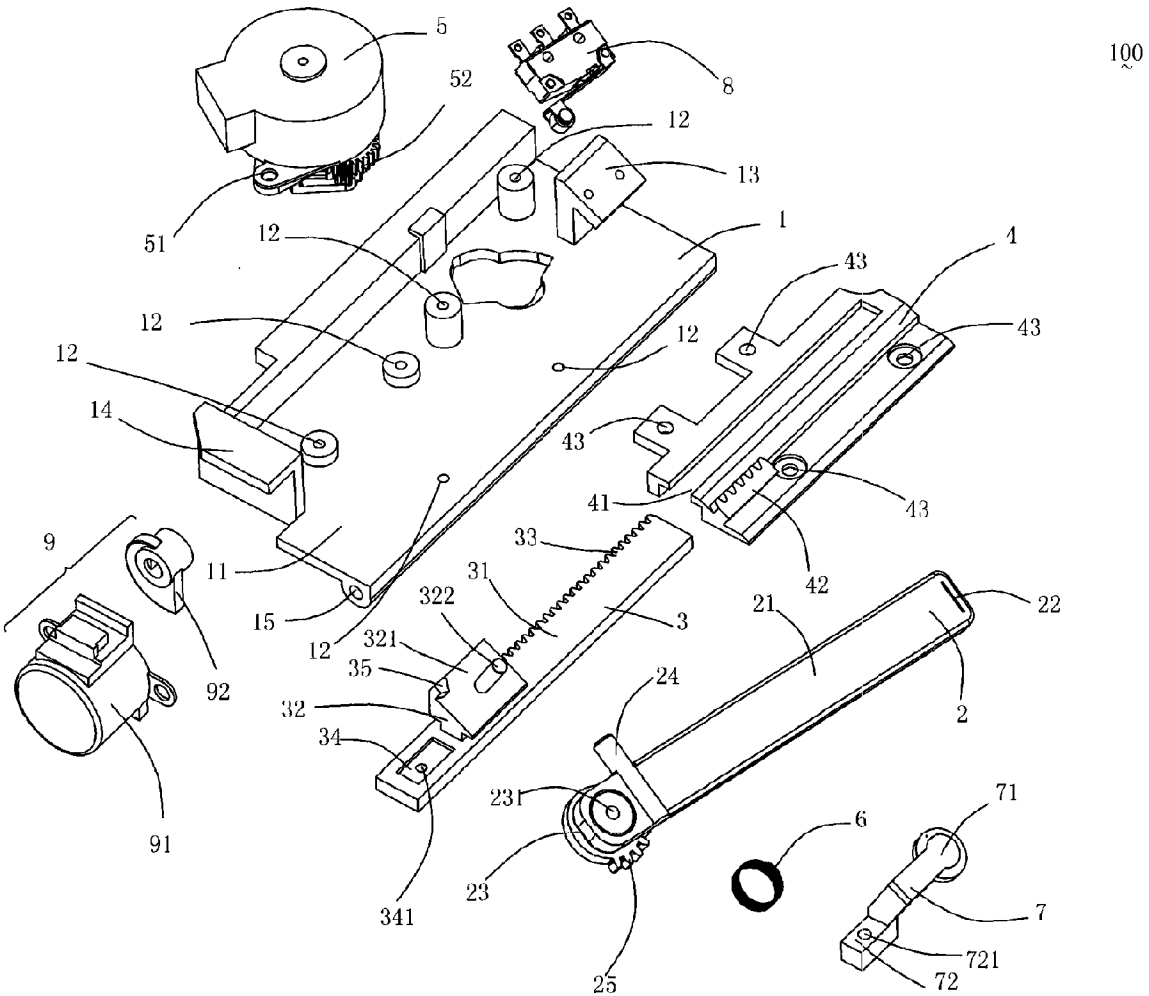
FIG. 2 is an exploded view of the jet apparatus shown in FIG. 1.

Referring to FIGS. 1 and 2, a jet apparatus 100 according to an exemplary embodiment includes a base 1, a mobile support 3 (e.g., a jet pipe support, movable base, etc.), a jet pipe 2 (e.g., a water delivery pipe or bidet wand) installed on the mobile support 3, a fixed support 4 for fixing the mobile support 3 onto the base 1, and a drive motor 5 for driving the mobile support 3 to move.

According to an exemplary embodiment, the base 1 is generally flat, and includes an installation surface 11. A plurality of installation holes 12 are formed on the installation surface 11. The base 1 acts to define a bearing surface for the mobile support 3 during translational motion, and also restricts the mobile support 3 from moving in the vertical direction. Although the base 1 is illustrated as having a generally flat or planar configuration, according to other exemplary embodiments, other configurations may also be used that allow the base 1 to provide this functionality.

The jet pipe 2 includes a longitudinal jet pipe body 21, a nozzle 22 formed at the front end of the jet pipe body 21 and a rotation portion 23 disposed at the rear end of the jet pipe body 21. The jet pipe 2 also includes an inlet pipe 24 connected with the jet pipe body 21. The inlet pipe 24 is used for connecting with an external cleaning water pipe. According to an exemplary embodiment, the rotation portion 23 is provided with a positioning hole 231 and the jet pipe 2 includes a fan-shaped engaging gear 25 disposed on the rotation portion 23. The gear structure described herein is intended to allow rotation of the jet pipe 2 and conversion of linear motion into rotary motion. According to other exemplary embodiments, other components may be used in place of the specific gearing structures shown. For example, according to other exemplary embodiments, a cable and pulley system, a cam system, a timing belt, a direct-drive-motor, or other types of components may be used to accomplish similar functions.

The mobile support 3 includes a longitudinal support body 31, an installation portion 32 disposed on the support body 31 by protruding therefrom, and a rack 33 disposed on one side of the support body 31. The jet pipe 2 is configured to be installed on the installation portion 32. The installation portion 32 includes an installation surface 321 and a positioning pole 322 disposed on the installation surface 321 by protruding therefrom and for engaging with the positioning hole 231 formed on the jet pipe 2. According to an exemplary embodiment, the installation surface 321 is an inclined surface.

The mobile support 3 further includes a receiving chamber 34 and an installation hole 341 located inside the receiving chamber 34. Moreover, the mobile support 3 includes a stop block 35 for limiting the jet pipe 2 when the jet pipe 2 extends out. In the embodiment shown in FIG. 1 and FIG. 3, the stop block 35 is located on the installation surface 321 of the installation portion 32 of the mobile support 3, butting against the end of the fan-shaped engaging gear 25 of the rotation portion 23 of the jet pipe 2.

The fixed support 4 is provided with a longitudinal opening 41 for receiving the support body 31 of the mobile support 3 and a matching gear 42 disposed at one end of the fixed support 4 for engaging with the engaging gear 25 of the jet pipe 2. The support body 31 of the mobile support 3 can move inside the opening 41. The fixed support 4 further includes a plurality of installation holes 43 for engaging with corresponding installation holes 12 on the base 1.

The drive motor 5 is provided with installation holes 51 for engaging with corresponding installation holes 12 on the base 1 and a transmission gear 52 for transmitting the motor's driving force.

The jet apparatus 100 further includes an elastic member 6 connected to the jet pipe 2 and a fixing member 7 that fixes the jet pipe 2 onto the mobile support 3. The elastic member 6 can provide an elastic force to the jet pipe 2. The stop block 35 of the mobile support 3 limits the jet pipe 2. Under a joint force of the elastic member 6 and the stop block 35, it ensures that the jet pipe 2 can always stay in a stable working position when it extends out. According to an exemplary embodiment, the elastic member 6 is a torsional spring. The elastic member provides a preloading torque to the jet pipe 2 to stabilize it in the working position. Although described as a torsional spring, according to other exemplary embodiments, different components may be used in place of the torsional spring (e.g., a linear spring or solenoid that pushes against a feature on the jet pipe body in the working position). The fixing member 7 includes an end cover 71 and a fixing block 72. The fixing block 72 is provided with an installation hole 721.

During installation, the mobile support 3 is assembled with the fixed support 4, and both the mobile support 3 and the fixed support 4 are installed onto the installation surface 11 of the base 1. The support body 31 of the mobile support 3 is received inside the opening 41 of the fixed support 4. The installation surface 321 of the installation portion 32 of the mobile support 3 protrudes out of the surface of the fixed support 4.

A plurality of installation holes 43 on the fixed support 4 are aligned with a plurality of corresponding installation holes 12 on the base 1, and are fixed together with fasteners such as screws or bolts. At this moment, the mobile support 3 is disposed between the fixed support 4 and the base 1, and is capable of moving relative to the fixed support 4 and the base 1. According to another exemplary embodiment, the fixed support 4 is formed integrally with the base 1. When the fixed support 4 is formed integrally with the base 1, the portion of the base 1 that supports the mobile support 3 can be treated as the fixed support 4.

Next, the jet pipe 2 is installed onto the installation portion 32 of the mobile support 3. The positioning pole 322 of the installation portion 32 of the mobile support 3 is received inside the positioning hole 231 of the rotation portion 23 of the jet pipe 2. As a result, the jet pipe 2 is rotatably installed on the installation portion 32 of the mobile support 3. According to another exemplary embodiment, the installation portion 32 of the mobile support 3 is provided with a positioning hole structure, while a positioning pole structure is disposed on the rotation portion 23 of the jet pipe 2 for engaging with the positioning hole.

Since the installation surface 321 is an inclined surface, when the jet pipe 2 is installed onto the installation portion 32 of the mobile support 3, the jet pipe 2 has a certain angle of inclination. When the jet apparatus 100 is installed onto a toilet, the jet pipe 2 has a downward slant. That is, the downward slant acts to position and define the angle of rotation of the jet pipe body 21 relative to the base 1. According to other exemplary embodiments, the jet pipe body 21 or the mobile support 3 could be formed to create the desired angle. According to other exemplary embodiments in which the design constraints of the toilet do not require it, an inclined surface may not be necessary and may be omitted from the design.

The end cover 71 of the fixing member 7 fixes the torsional spring 6 onto the jet pipe 2 and fixes the jet pipe 2 onto the installation portion 32 of the mobile support 3. The fixing block 72 of the fixing member 7 is partially received inside the receiving chamber 34 of the mobile support 3, wherein the installation hole 721 on the fixing block 72 is aligned with the installation hole 341 located inside the receiving chamber 34 and fixed with a screw. One end of the torsional spring 6 is fixed on the rotation portion 23 of the jet pipe 2, while the other end thereof is fixed on the end cover 71 of the fixing member 7. The fixing member 7 can also adopt other fixing structures. According to another exemplary embodiment, the fixing member 7 is a nut with internal screw threads. The free end of the positioning pole 322 of the installation portion 32 of the mobile support 3 is provided with external screw threads. The nut engages with the positioning pole 322 to fix the jet pipe 2.

According to another exemplary embodiment, the elastic member 6 has a torsional spring structure, which has advantages of small volume and easy installation. In another embodiment, the elastic member 6 can indeed be other elastic members, such as a spring piece (e.g., a torsional spring, linear spring, or solenoid).

The drive motor 5 may then be installed to the base 1. Installation holes 51 of the drive motor 5 are aligned with the installation holes 12 on the base 1, which are fixed with screws. After the installation, the transmission gear 52 engages with the rack 33 of the mobile support 3. The drive motor 5 turns forwardly or in reverse and drives the mobile support 3 to move to left or to right. In such an embodiment, the movement control of the mobile support 3 by the drive motor 5 is realized through the engagement between the rack 33 and the transmission gear 52. The rack 33 and the transmission gear 52 form a transmission structure between the mobile support 3 and the drive motor 5. According to another exemplary embodiment, the jet apparatus 100 can be provided with a different type of transmission mechanism between the mobile support 3 and the drive motor 5, for example, a steel belt or synchronous belt structure disposed between the mobile support 3 and the drive motor 5. When the drive motor 5 turns, the steel belt or synchronous belt drives the mobile support 3 to move at the same time. The drive motor may provide rotational motion and the mobile support acts to translate the rotational motion into linear motion. According to other exemplary embodiments, cables and pulleys and/or rollers may be used. According to other exemplary embodiments, the drive motor could be positioned on the mobile support and the gear rack could be fixed to the base. According to still other exemplary embodiments, the drive motor could be replaced with a linear drive mechanism.

As shown in FIG. 1, according to an exemplary embodiment, the jet apparatus 100 is in an initial position. In other words, the engaging gear 25 of the jet pipe 2 engages with the matching gear 42 of the fixed support 4, such that the jet pipe body 21 of the jet pipe 2 retracts to the area where the base 1 is located. The jet apparatus 100 also includes a position switch 8 according to an exemplary embodiment. The position switch 8 detects whether the jet pipe is in the initial position and further controls the drive motor 5. In the embodiments shown in FIGS. 1-3, the position switch 8 is a mechanical touch switch 8. An installation platform 13 is disposed on the base 1 for installing the mechanical touch switch 8. When the jet pipe 2 is in the above initial position, the jet pipe body 21 touches on the mechanical touch switch 8 such that the drive motor 5 knows that the jet pipe 2 is in the initial position and therefore stops. According to other exemplary embodiments, the position switch 8 can indeed be a non-touch switch that may include, for example, Hall elements. According to an exemplary embodiment, the position switch acts to measure/detect when the jet pipe is in the initial rotational position. According to other exemplary embodiments, the position switch may be replaced with an encoder or a mechanical hard-stop with motor drive current detection and controls.

Figure 3:
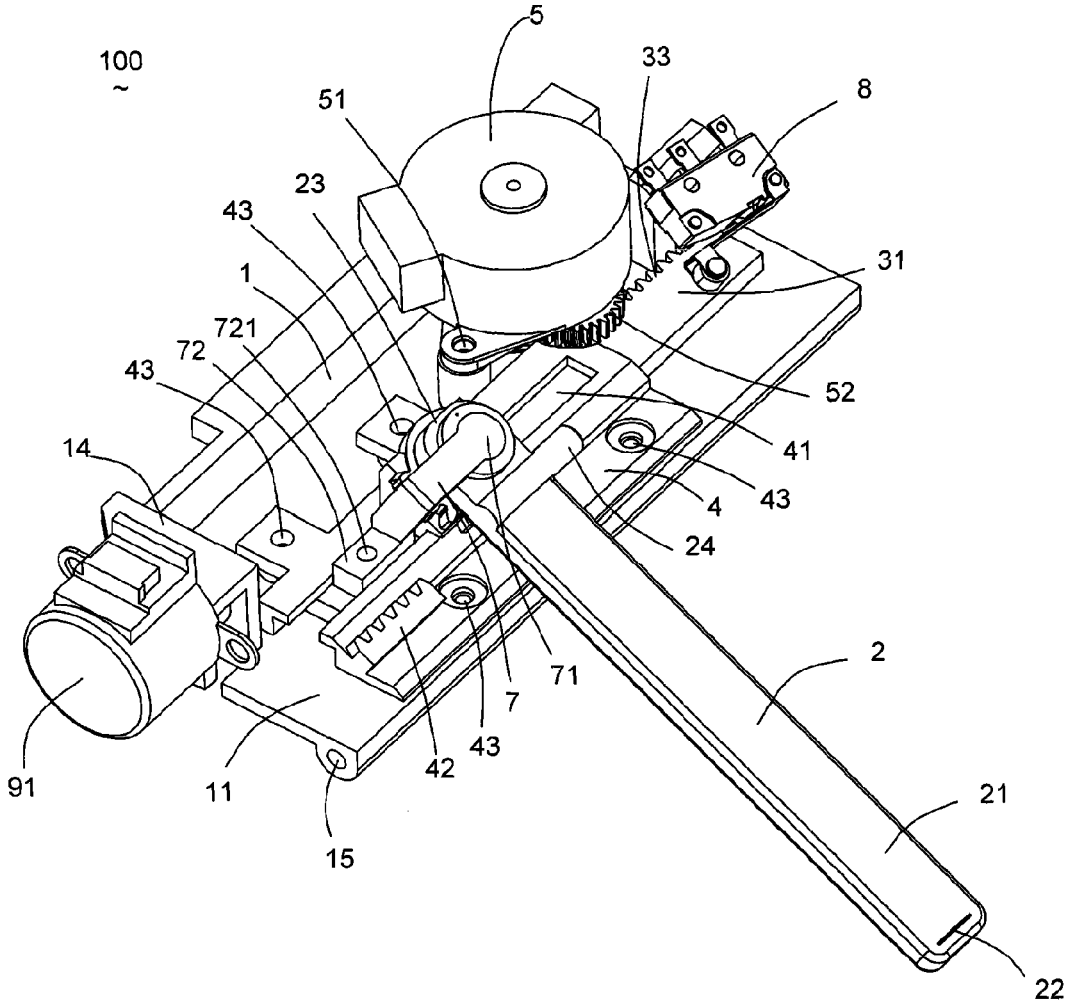
FIG. 3 is a perspective view of the jet apparatus shown in FIG. 1 in a working state according to an exemplary embodiment.

As shown in FIG. 3, in a working state, the drive motor 5 drives the mobile support 3 to move. When the engaging gear 25 of the jet pipe 2 disengages from the matching gear 42 of the fixed support 4, the jet pipe 2 is in a working position. Under a joint force of the torsional spring 6 and the stop block 35 of the mobile support 3, the jet pipe 2 stays in the working position. The purpose of the torsional spring 6 and the stop block 35 is to ensure that the jet pipe 2 stays in the working position.

The above torsional spring 6 and the stop block 35 form a stabilization mechanism of the jet pipe 2. The stabilization mechanism of the jet pipe 2 of the jet apparatus 100 according to the present invention may also not use the structure of the torsional spring 6 and the stop block 35. According to another exemplary embodiment, the jet apparatus 100 according bumps on the installation portion 32 of the mobile support 3, while positioning holes are formed on the rotation portion 23 of the jet pipe 2 for engaging with the bumps. When the jet pipe 2 is in the working position, the bumps and positioning holes engage to ensure that the jet pipe 2 is in a stable working position. According to other exemplary embodiments, the jet apparatus 100 may employ other position limiting structures as a stabilization mechanism for the jet pipe 2.

Furthermore, the position of the jet pipe 2 is adjusted by moving the mobile support 3.

According to an exemplary embodiment, the jet apparatus 100 may include, based on the above structure, a base driving mechanism 9 that drives the base 1 to move. The base driving mechanism 9 is disposed on one side of the base 1, and includes a base drive motor 91 and a cam 92 connected to the drive motor. The base 1 is provided with a blocking portion 14 for engaging with the cam 92. The base 1 further includes an axle portion 15 disposed on both ends of the base 1. When the base 1 is installed onto a toilet, the axle portion 15 engages with a corresponding structure of the toilet such that the base 1 can rotate around the line on which the axle portion 15 is. According to the exemplary embodiments shown in FIGS. 1-3, the axle portion 15 includes two holes, while the toilet is provided correspondingly with two positioning pin structures (not shown) for engaging with the two holes. The exact position of the axle portion 15 can be determined according to actual needs. According to another exemplary embodiment, the axle portion can include two positioning pins, while hole structures are correspondingly formed on the toilet to engage with the two positioning pins.

The base driving mechanism 9 is configured to be installed and fixed onto a toilet. The base drive motor 91 drives the cam 92 to rotate. The cam 92 butts against the blocking portion 14 of the base 1 such that the base 1 rotates around the line on which the axle portion 15 is. Since the jet pipe 2 is installed together with the base 1, the jet pipe 2 rotates along with the rotation of the base 1 and thereby changes the angle of inclination of the jet pipe 2, realizing the adjustment of the jet pipe 2 in multiple directions. Therefore, a user can have a more comfortable cleaning experience by adjusting the jet pipe 2 in multiple directions.

Figure 4:
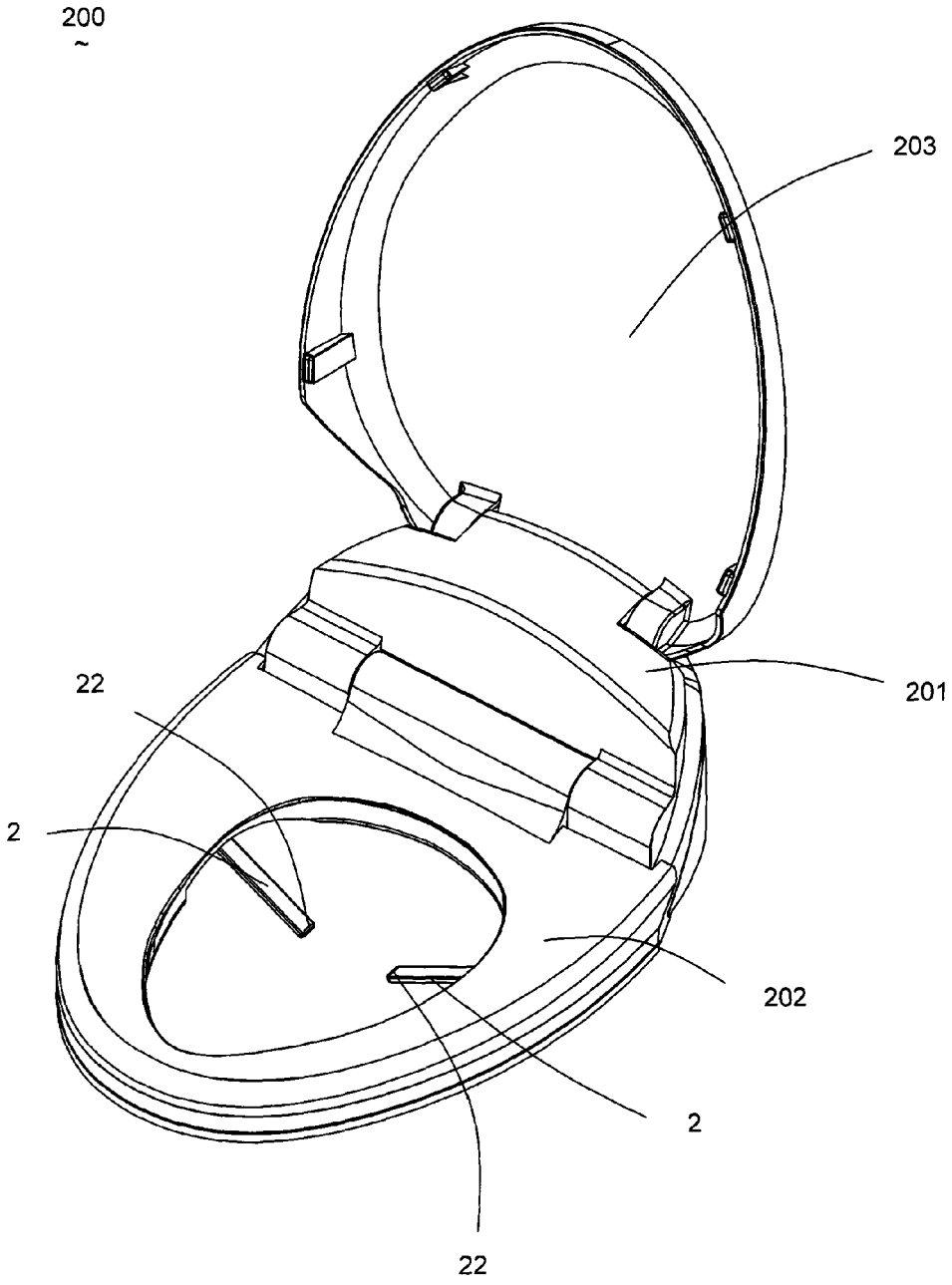
FIG. 4 is a perspective view of a toilet installed with a jet apparatus according to an exemplary embodiment.
Figure 5:
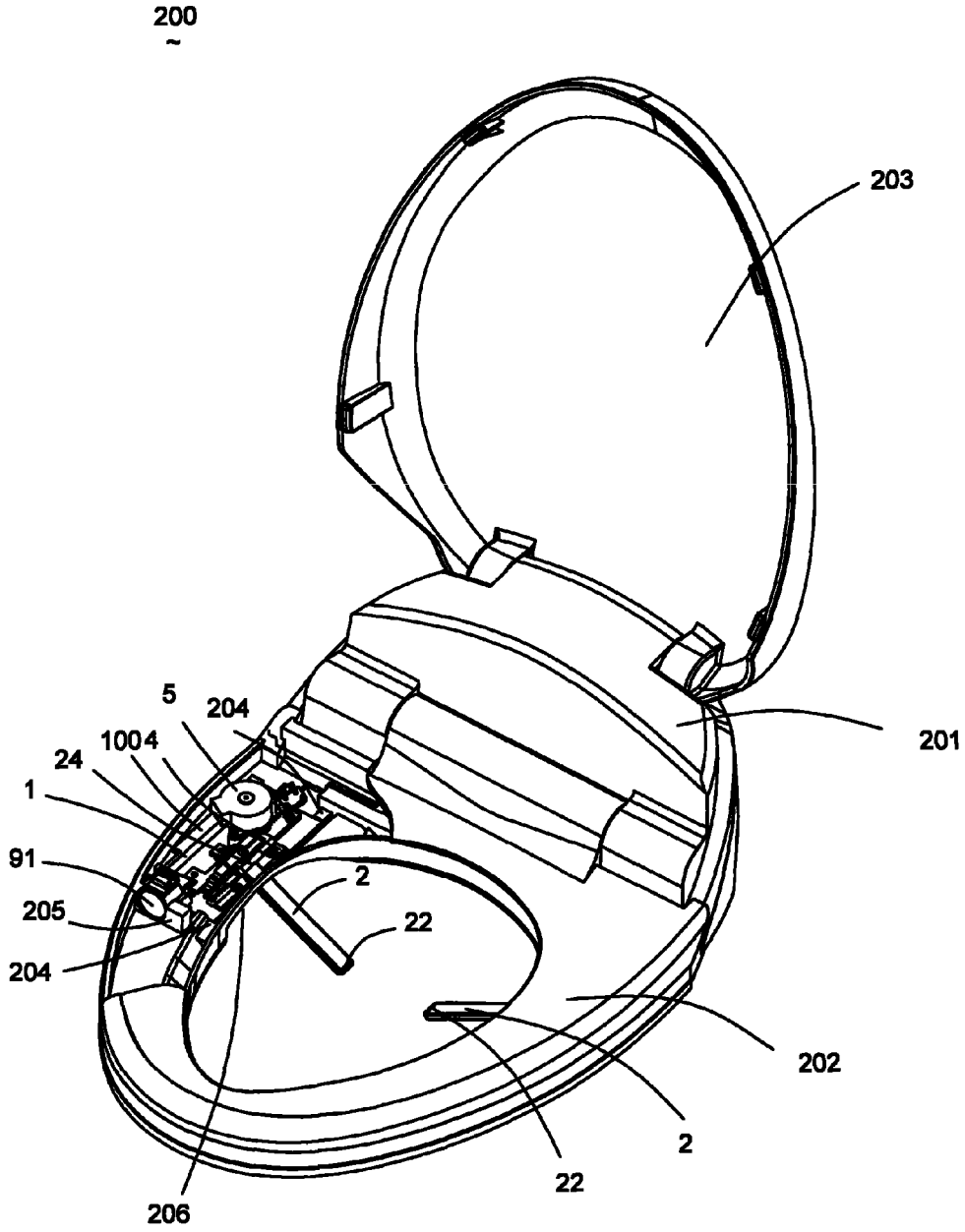
FIG. 5 is a partial sectional view of the toilet and jet apparatus shown in FIG. 4.

FIGS. 4 and 5 show the toilet 200 installed with the jet apparatus 100 according to an exemplary embodiment. The toilet 200 includes a body 201, a seat ring 202 and a lid 203. The jet apparatus 100 can be installed inside the body 201 or inside the seat ring 202. According to the exemplary embodiments shown in FIGS. 4 and 5, the jet apparatus 100 is installed inside the seat ring 202. The seat ring 202 is provided with an engaging portion 204 for engaging with the axle portion 15 of the base 1 of the jet apparatus 100 and an installation portion 205 for fixing the base drive motor 91. When the engaging portion 204 engages with the axle portion 15 of the base 1, the base 1 can rotate around the line on which the axle portion 15 is. According to an exemplary embodiment, the axle portion 15 is a hole structure, while the engaging portion 204 is a positioning pin structure for engaging with the hole. The base drive motor 91 is fixed with the installation portion 205 by means of screw locking According to other exemplary embodiments, any mechanical joining method could be used to fix the two items together (e.g., by clamping, clipping, welding, or otherwise securing the components together).

The seat ring 202 is further provided with an opening 206 for the jet pipe 2 to extend out or move. According to an exemplary embodiment shown in FIGS. 4 and 5, there are two jet apparatuses 100, which are installed, respectively, on two sides of the toilet seat ring 202 and close to the center position thereof. The inlet pipe 24 of the jet pipe 2 is connected with the corresponding supply valve of the toilet 200 via the cleaning water inlet pipe.

According to another exemplary embodiment, the jet apparatus 100 is installed inside the body 201 of the toilet 200. Similarly, an installation portion for fixing the base drive motor 91, an engaging portion for engaging with the axle portion 15 of the base 1 and an opening for the jet pipe 2 to extend out or move are provided inside the body 201.

To use the jet apparatuses described herein, a user operates an external remote controller or a control panel to control the jet apparatus 100 via a microprocessor (not shown). The microprocessor is typically installed inside the body 201 of the toilet 200. Upon receiving a control signal, the microprocessor drives the drive motor 5 to rotate. The drive motor 5 drives the mobile support 3 to move through the engagement between the transmission gear 52 and the rack 33 of the mobile support 3. When the engaging gear 25 of the jet pipe 2 disengages from the matching gear 42 of the fixed support 4, the body 21 of the jet pipe extends out of the opening 206 of the seat ring 202 of the toilet 200. Since the jet pipe 2 has a downward slant when installed on the mobile support 3, the jet pipe 2 also has a downward slant relative to the seat ring 202 when the jet apparatus 100 is installed onto the toilet 200, making it convenient to use.

According to an exemplary embodiment, a user can control the drive motor 5 using an external remote controller or a control panel, and in turn control the movement of the mobile support 3, thereby realizing the adjustment of forward and backward positions of the jet pipe 2. As a result, the nozzle 22 of the jet pipe 2 can spray cleaning water to accurately clean the user.

According to an exemplary embodiment, a user can also control the base drive motor 91 using an external remote controller or a control panel such that the cam 92 butts against the blocking portion 14 of the base 1 and drives the base 1 to rotate around the line on which the axle portion 15 is. Since the jet pipe 2 is installed together with the base 1, the jet pipe 2 rotates along with the rotation of the base 1 and thereby changes the angle of inclination of the jet pipe 2 relative to the seat ring 202, realizing the adjustment of the jet pipe 2 in multiple directions. Therefore, a user can have a more comfortable cleaning experience by adjusting the jet pipe 2 in multiple directions.

Previously known jet apparatuses tend to have relatively large longitudinal sizes. Since toilet bodies also typically have relatively large longitudinal sizes, jet apparatuses have typically installed inside toilet bodies. The jet apparatus 100 described herein, in contrast, has a relatively small longitudinal size and therefore is suitable for installation on toilets with insufficient longitudinal sizes (i.e., toilets having narrower configurations). Because of the above-described advantages of the jet apparatus 100, the jet apparatus 100 can be installed on the seat ring 202 of the toilet 200, such that the jet pipe 2 can extend from the seat ring and clean the user from the sides. With existing jet apparatuses that extend from the toilet body and spray cleaning water from back to front, such a configuration tends to cause the used cleaning water to impact the genital area in front of the anal area after cleaning the anal area. However, it is impossible for jet pipes of the prior art to be installed inside toilet seat rings. Because the jet apparatus 100 described herein may be installed on the seat ring 202 of the toilet 200, such that the jet pipe 2 can extend from the side and spray cleaning water to a user by facing the user or slightly from front to back, such a configuration overcomes the above drawback of the prior art.

According to an exemplary embodiment, the jet apparatus 100 can adjust the jet pipe 2 in multiple directions, such that the toilet 200 installed with the jet apparatus 100 can provide a more comfortable cleaning experience for users.

According to a particular exemplary embodiment, a jet apparatus includes a base, a fixed support, a mobile support, a jet pipe installed on the mobile support, and a drive motor for driving the mobile support to move. The fixed support is provided with a longitudinal opening. The mobile support comprises a longitudinal support body and an installation portion disposed on the support body. The support body is received inside the opening of the fixed support and is capable of moving inside of the opening. The jet pipe is rotatably installed on the installation portion of the mobile support, and includes a jet pipe body, a nozzle formed at the front end of the jet pipe body, a rotation portion disposed at the rear end of the jet pipe body, and an inlet pipe connected with a cleaning water pipe. The jet pipe also includes a fan-shaped engaging gear disposed on the rotation portion, and a matching gear for engaging with the fan-shaped engaging gear is disposed on the fixed support. The jet apparatus and toilet described herein may allow for enhanced adjustability of the jet apparatus and may also allow water to travel from the front to the rear of the genital area such that water first impacts the genital area and then travels to and impacts the rear anal area of the user. This in turn may provide a more comfortable experience for the user.

Other features of the jet apparatus will be described below in further detail. For example, according to an exemplary embodiment, the mobile support may include a rack disposed on the support body, and a transmission gear for engaging with the rack may be formed on the drive motor. The jet apparatus may also include a steel belt or synchronous belt disposed between the support body of the mobile support and the drive motor.

A jet pipe stabilization mechanism intended for use with the jet apparatus may include an elastic member connected between the jet pipe and the mobile support and a stop block may be disposed on the mobile support. According to an exemplary embodiment, the elastic member is a torsional spring.

A fixing member that fixes the jet pipe onto the mobile support may also be included. The fixing member may include an end cover for fixing the jet pipe onto the installation portion of the mobile support and a fixing block that is fixed to the mobile support. The installation portion of the mobile support may include an installation surface (which may be an inclined surface according to an exemplary embodiment) and a positioning pole disposed on the installation surface by protruding therefrom, and a positioning hole may be formed on the rotation portion of the jet pipe for engaging with the positioning hole.

The jet apparatus may also include a base driving mechanism that includes a base drive motor and a cam connected to the drive motor. A blocking portion for engaging with the cam may be formed on the base, with the base including an axle portion disposed on both ends of the base.

According to another exemplary embodiment, a toilet may include a jet apparatus as described herein. The jet apparatus may include a base, a fixed support, a mobile support, a jet pipe installed on the mobile support, and a drive motor for driving the mobile support to move. The fixed support is provided with a longitudinal opening. The mobile support may include a longitudinal support body and an installation portion disposed on the support body. The support body is received inside the opening of the fixed support and capable of moving inside the opening. The jet is rotatably installed on the installation portion of the mobile support, and includes a jet pipe body, a nozzle formed at the front end of the jet pipe body, a rotation portion disposed at the rear end of the jet pipe body, and an inlet pipe connected with a cleaning water pipe. The jet may also include a fan-shaped engaging gear disposed on the rotation portion, and a matching gear for engaging with the fan-shaped engaging gear is disposed on the fixed support.

The mobile support may also include a rack disposed on the support body, while a transmission gear for engaging with the rack may be formed on the drive motor. A steel belt or synchronous belt may be disposed between the support body of the mobile support and the drive motor.

The jet apparatus may also include a jet pipe stabilization mechanism that comprises an elastic member connected between the jet pipe and the mobile support and a stop block disposed on the mobile support. According to an exemplary embodiment, the elastic member is a torsional spring.

The jet apparatus may also include a fixing member that fixes the jet pipe onto the mobile support. The fixing member may include an end cover for fixing the jet pipe onto the installation portion of the mobile support and a fixing block that is fixed to the mobile support. The installation portion of the mobile support may include an installation surface (which may be an inclined surface according to an exemplary embodiment) and a positioning pole disposed on the installation surface by protruding therefrom, and a positioning hole may be formed on the rotation portion of the jet pipe for engaging with the positioning hole.

The jet apparatus may also include a base driving mechanism that includes a base drive motor and a cam connected to the drive motor. A blocking portion for engaging with the cam may be formed on the base. The base may also include an axle portion disposed on both ends of the base, and an engagement portion is disposed on the seat ring.

The jet apparatus may be installed inside the seat ring of the toilet, and an opening may be formed on the seat ring such that the jet pipe can extend out or move. According to an exemplary embodiment, the toilet may include two of the jet apparatuses described herein (e.g., on two sides of the toilet seat ring and close to the center position thereof).

According to another exemplary embodiment, a toilet may include a jet apparatus that is installed inside the seat ring of the toilet. The jet apparatus may include a base, a mobile support installed on the base and capable of relative movement to the base, a jet pipe installed on the mobile support, and a drive motor for driving the mobile support to move. An opening may be formed on the seat ring such that the jet pipe can extend out or move. The base is provided with an axle portion, and an engagement portion is disposed on the seat ring for engaging with the axle portion. The mobile support may include a longitudinal support body and an installation portion disposed on the support body. The jet pipe may be installed on the installation portion of the mobile support and may be provided with a rotation portion capable of rotation and installed on the installation portion of the mobile support. The jet apparatus may also include a base driving mechanism that drives the base to rotate around the line of the axle portion.

The mobile support may include a rack disposed on the support body, while a transmission gear for engaging with the rack may be formed on the drive motor. The base driving mechanism may include a base drive motor and a cam connected to the drive motor and butted against the base. The jet apparatus may also include an elastic member connected between the jet pipe and the mobile support and may also include a stop block disposed on the mobile support.

It should be noted that the accompanying drawings are only intended to facilitate the description of the exemplary embodiments described herein, and are not intended as limiting to the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilet and jet apparatus as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A jet apparatus for a toilet comprising:

a base;

a fixed support provided with a longitudinal opening;

a mobile support comprising a longitudinal support body and an installation portion disposed on the support body, wherein the support body is received inside the opening of the fixed support and is capable of moving inside the opening;

a jet pipe rotatably installed on the installation portion of the mobile support and comprising a jet pipe body, a nozzle formed at the front end of the jet pipe body, a rotation portion disposed at the rear end of the jet pipe body, and an inlet pipe connected with a cleaning water pipe; and a drive motor for driving the mobile support to move;

wherein the jet apparatus further comprises a fan-shaped engaging gear disposed on the rotation portion, and a matching gear for engaging with the fan-shaped engaging gear disposed on the fixed support.

2. The jet apparatus as set forth in claim 1, wherein the mobile support further comprises a rack disposed on the support body and a transmission gear for engaging with the rack is provided on the drive motor.

3. The jet apparatus as set forth in claim 1, wherein the jet apparatus comprises a steel belt or a synchronous belt disposed between the support body of the mobile support and the drive motor.

4. The jet apparatus as set forth in claim 1, wherein the jet apparatus further comprises a jet pipe stabilization mechanism.

5. The jet apparatus as set forth in claim 4, wherein the jet pipe stabilization mechanism comprises an elastic member connected between the jet pipe and the mobile support and a stop block is disposed on the mobile support.

6. The jet apparatus as set forth in claim 5, wherein the elastic member is a torsional spring.

7. The jet apparatus as set forth in claim 1, wherein the jet apparatus further comprises a fixing member that fixes the jet pipe onto the mobile support.

8. The jet apparatus as set forth in claim 7, wherein the fixing member comprises an end cover for fixing the jet pipe onto the installation portion of the mobile support and a fixing block that is fixed to the mobile support.

9. The jet apparatus as set forth in claim 1, wherein the installation portion of the mobile support comprises an installation surface and a positioning pole disposed on the installation surface by protruding therefrom, and a positioning hole is formed on the rotation portion of the jet pipe for engaging with the positioning hole.

10. The jet apparatus as set forth in claim 9, wherein the installation surface is an inclined surface.

11. The jet apparatus as set forth in claim 1, wherein the jet apparatus further comprises a base driving mechanism that comprises a base drive motor and a cam connected to the drive motor, and wherein a blocking portion for engaging with the cam is provided on the base.

12. The jet apparatus as set forth in claim 11, wherein the base further comprises an axle portion disposed on both ends of the base.

13. A toilet comprising a jet apparatus, wherein the jet apparatus comprises:

a base;

a fixed support comprising a longitudinal opening;

a mobile support comprising a longitudinal support body and an installation portion disposed on the support body, wherein the support body is received inside the opening of the fixed support and is capable of moving inside the opening;

a jet pipe rotatably installed on the installation portion of the mobile support and comprising a jet pipe body, a nozzle formed at the front end of the jet pipe body, a rotation portion disposed at the rear end of the jet pipe body, and an inlet pipe connected with a cleaning water pipe; and a drive motor for driving the mobile support to move;

wherein the jet apparatus further comprises a fan-shaped engaging gear disposed on the rotation portion, and a matching gear for engaging with the fan-shaped engaging gear disposed on the fixed support.

14. The toilet as set forth in claim 13, wherein the mobile support further comprises a rack disposed on the support body, and a transmission gear for engaging with the rack is provided on the drive motor.

15. The toilet as set forth in claim 13, wherein the jet apparatus comprises a steel belt or a synchronous belt disposed between the support body of the mobile support and the drive motor.

16. The toilet as set forth in claim 13, wherein the jet apparatus further comprises a jet pipe stabilization mechanism.

17. The toilet as set forth in claim 16, wherein the jet pipe stabilization mechanism comprises an elastic member connected between the jet pipe and the mobile support and a stop block is disposed on the mobile support.

18. The toilet as set forth in claim 17, wherein the elastic member is a torsional spring.

19. The toilet as set forth in claim 13, wherein the jet apparatus further comprises a fixing member that fixes the jet pipe onto the mobile support.

20. The toilet as set forth in claim 19, wherein the fixing member comprises an end cover for fixing the jet pipe onto the installation portion of the mobile support and a fixing block is fixed to the mobile support.

21. The toilet as set forth in claim 13, wherein the installation portion of the mobile support comprises an installation surface and a positioning pole disposed on the installation surface by protruding therefrom, and a positioning hole is located on the rotation portion of the jet pipe for engaging with the positioning hole.

22. The toilet as set forth in claim 21, wherein the installation surface is an inclined surface.

23. The toilet as set forth in claim 13, wherein the jet apparatus further comprises a base driving mechanism that comprises a base drive motor and a cam connected to the drive motor; and wherein a block portion for engaging with the cam is provided on the base.

24. The toilet as set forth in claim 23, wherein the base further comprises an axle portion disposed on both ends of the base, and an engagement portion is disposed on a seat ring of the toilet.

25. The toilet as set forth in claim 13, wherein the jet apparatus is installed inside a seat ring of the toilet, and an opening is provided on the seat ring such that the jet pipe can extend out of the opening or move.

26. The toilet as set forth in claim 25, wherein the toilet comprises two jet apparatuses installed, respectively, on two sides of the toilet seat ring and close to a center position thereof.

27. A toilet comprising:

a jet apparatus installed inside a seat ring of the toilet, wherein the jet apparatus comprises:

a base comprising an axle portion;

a mobile support installed on the base and capable of movement relative to the base, wherein the mobile support comprises a longitudinal support body and an installation portion disposed on the support body;

a jet pipe installed on the installation portion of the mobile support and comprising a rotation portion; and a drive motor for driving the mobile support to move;

wherein the seat ring comprises an opening configured to allow the jet pipe to extend out of the opening or move;

wherein the seat ring comprises an engagement portion for engaging with the axle portion of the base; and wherein the jet apparatus further comprises a base driving mechanism that drives the base to rotate around the line of the axle portion.

28. The toilet as set forth in claim 27, wherein the mobile support further comprises a rack disposed on the support body, and a transmission gear for engaging with the rack is provided on the drive motor.

29. The toilet as set forth in claim 27, wherein the base driving mechanism comprises a base drive motor and a cam connected to the drive motor and butted against the base.

30. The toilet as set forth in claim 27, wherein the jet apparatus further comprises an elastic member connected between the jet pipe and the mobile support and a stop block disposed on the mobile support.

* * * * *